US005918877A

United States Patent [19]

Takei et al.

[11] Patent Number: 5,918,877

[45] **Date of Patent: *Jul. 6, 1999**

[54] CUT SHEET FEEDING DEVICE HAVING A FUNCTION OF DETECTING A SKEW OF THE SHEET TO BE FED

[75] Inventors: Yukako Takei; Tamio Amagai; Yoshio Tabata, all of Kawasaki, Japan

[73] Assignee: Fujitsu Limited, Kawasaki, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/663,776

[22] Filed: Jun. 14, 1996

[30] Foreign Application Priority Data

Jun. 16, 1995 [JP] Japan ..... 7-150137

[51] Int. Cl.[6] ..... B65H 7/08

[52] U.S. Cl. ..... 271/261; 271/265.03

[58] Field of Search ..... 271/227, 261, 271/265.03, 259, 258.04, 265.02

[56] References Cited

U.S. PATENT DOCUMENTS

| | | | |
|---|---|---|---|
| 4,944,505 | 7/1990 | Sherman, III | 271/265.03 |
| 5,507,481 | 4/1996 | Meyer et al. | 271/261 X |

FOREIGN PATENT DOCUMENTS

| | | | |
|---|---|---|---|
| 145750 | 9/1982 | Japan | 271/265.03 |
| 23054 | 1/1986 | Japan | 271/227 |
| 41139 | 2/1987 | Japan | 271/227 |
| 154556 | 6/1988 | Japan | 271/265.03 |
| 242851 | 10/1988 | Japan | 271/261 |
| 275351 | 11/1989 | Japan | 271/261 |
| 106539 | 4/1990 | Japan | 271/265.03 |
| 138252 | 6/1991 | Japan | 271/265.03 |
| 338859 | 12/1993 | Japan | 271/227 |

*Primary Examiner*—Boris Milef

*Attorney, Agent, or Firm*—Armstrong, Westerman, Hattori, McLeland & Naughton

[57] ABSTRACT

A cut sheet feeding device having a function of detecting a skew of the sheet to be fed is incorporated in an image reader, a printing apparatus, etc. The cut sheet feeding device is capable of surely detecting the skew of a document without an operator visually monitoring the same. The cut sheet feeding device has size sensors corresponding to standard sheet sizes, respectively, for detecting the size of a document that is being fed along a feeding path. The detected document size is compared with a set document size stored in advance. If the detected document size is greater than the set document size, it is determined that there is an abnormality in feeding the document. The cut sheet feeding device also has a document passage detector for detecting the passage of the document. The outputs of the document passage sensor and size sensor are compared with each other, to calculate a skew of the document that is being fed. This skew is used to determine whether or not the document is being fed normally.

5 Claims, 15 Drawing Sheets

Fig.5A

| | | REFERENCE VALUE FOR JUDGING SKEW DETECTED BY EACH SIZE SENSOR | | | |
|---|---|---|---|---|---|
| | | SA3 | SB4 | SA4 | SB5 |
| SIZE OF DOCUMENT | A3 | 1.34mm | 1.13mm | 0.96mm | 0.74mm |
| | B4 | — | 1.13mm | 0.96mm | 0.74mm |
| | A4 | — | — | 0.96mm | 0.74mm |
| | B5 | — | — | — | 0.74mm |

Fig.5B

| | | REFERENCE VALUE IN DOTS FOR JUDGING SKEW DETECTED BY EACH SIZE SENSOR | | | |
|---|---|---|---|---|---|
| | | SA3 | SB4 | SA4 | SB5 |
| SIZE OF DOCUMENT | A3 | 11DOTS | 9DOTS | 8DOTS | 6DOTS |
| | B4 | — | 9DOTS | 8DOTS | 6DOTS |
| | A4 | — | — | 8DOTS | 6DOTS |
| | B5 | — | — | — | 6DOTS |

CUT SHEET FEEDING DEVICE HAVING A FUNCTION OF DETECTING A SKEW OF THE SHEET TO BE FED

BACKGROUND OF THE INVENTION

1. Field of the Invention

The present invention relates to a cut sheet feeding device having a function of detecting a skew of the sheet to be fed. In particular, the present invention relates to a cut sheet feeding device capable of detecting a skew of the document of standard size to be read by an image scanner having a mechanism for feeding the document, or a skew of the blank form to be printed by a printer having a mechanism for feeding the form.

2. Description of the Related Art

Computers are widely used in offices and homes to print texts on a blank form with a printer, or read an image from printed matter with an image scanner and store the image. The form to be printed by printer or the document to be read by image scanner must have no skew in a sheet feeding direction.

To read an image without skew from a document by image scanner, it is necessary to detect a skew of the document and correct it before feeding and reading the document.

If the blank form to be printed has a skew, print on the form will be skewed to provide a bad appearance.

Various cut sheet feeding devices capable of detecting a skew of the document to be fed have been proposed. In the following explanation, a blank form printed by printer or printed matter read by scanner is referred to as a document.

Some image scanners read data from a document while feeding the document. These image scanners have size sensors for detecting the size of the document fed. The size sensors detect, for example, document sizes B5, A4, B3, and A3, respectively. The size of a document is determined by checking which sensors the document has covered.

In addition to the size sensors, the image scanner usually has two document sensors for detecting the feeding state of a document. The document sensors are arranged along a document feeding path, to determine whether or not the leading edge of the document is moving correctly. For example, one of the document sensors is used to determine whether or not the document is moving correctly, and the other to determine the timing for reading the document.

The operator of the image scanner sets the size of a document to be read, and the document is fed into the image scanner. The size sensors and document sensors provide outputs to indicate whether or not they have detected the document. The outputs of the sensors are transferred to a computer connected to the image scanner, and the computer detects a skew of the document according to the outputs.

The skew detected by the computer is displayed on a display. The displayed skew involves a skew in a main scanning direction, i.e., a gap between the left and right ends of the leading edge of the document and a skew in a secondary scanning direction, i.e., a gap between the front and rear ends of the left edge of the document.

According to the prior art, the operator must check the gaps in the main and secondary scanning directions of every document on the display to determine whether or not the document is skewed. This is laborious for the operator.

Recent image scanners operate at high speed, and therefore, it is very difficult for the operator to check the skew of each document on the display. Even if the operator finds a skew on a given document, it is nearly impossible for the operator to quickly carry out an error correction process.

SUMMARY OF THE INVENTION

An object of the present invention is to provide a cut sheet feeding device having a function of surely detecting a skew of the document to be fed, without requiring the operator to check each document on a display.

In order to accomplish the object, the present invention provides a cut sheet feeding device having a function of detecting a skew of the document to be fed. The feeding device is incorporated in a peripheral apparatus that has a mechanism of feeding a document and is connected to a computer having a display, a data input unit, and a data processing unit. The cut sheet feeding device has a size detector, a size memory, a comparator, and an abnormality determination unit. The size detector consists of size sensors that are linearly arranged in a document feeding path orthogonally to a document feeding direction, to detect standard document sizes. The size memory stores a document size entered through the data input unit. The comparator compares the document size detected by the size detector with the document size stored in the size memory. If the detected document size is greater than the stored document size, the abnormality determination unit determines that an abnormality has occurred in feeding the document.

The standard document sizes include at least A3, A4, B4, and B5.

The cut sheet feeding device of the present invention further has a document passage detector, a skew calculator, an allowable skew memory, a skew comparator, and a skew determination unit. The document passage detector is aligned with the size detector on the same straight line and detects the passage of a document. The skew calculator calculates the skew of the document that is being fed, according to the document size detected by the size detector and the passage of the document detected by the document passage detector. The allowable skew memory stores an allowable skew for each document size. If the abnormal determination unit determines that the document is normally being fed, the skew comparator compares the skew of the document calculated by the skew calculator with the allowable skew stored in the allowable skew memory for the document size. If the skew of the document is over the allowable skew, the skew determination unit determines that the document that is being fed is skewed.

Each allowable skew stored in the allowable skew memory is calculated according to the distance between a given size sensor and the document passage detector and is stored in a table.

When a step motor is employed to feed a document, each skew provided by the skew calculator may be represented with the number of pulses applied to the step motor after the size detector detects the document until the document passage detector detects the same document. In this case, the allowable skew for each document size stored in the allowable skew memory is a corresponding number of pulses. The skew comparator compares the number of detected pulses with the stored number.

If the document is being normally fed, no size sensor for a size larger than the set document size detects the document. If a size sensor for a larger document size detects the document, it is immediately determined that an abnormality has occurred in feeding the document.

If no such size sensor for a larger document size detects the document, the skew of the document is calculated according to the difference between the time when the size detector has detected the document and the time when the document passage detector has detected the same, and it is determined whether or not the calculated skew is greater than an allowable skew.

When the step motor is employed to feed the document, the skew of a document is represented with the number of pulses applied to the step motor.

Each allowable skew may be calculated according to a document size to be set and the distance between a corresponding size sensor and the document passage detector and may be stored in a table in the allowable skew memory. This arrangement may easily determine the skew of each document.

BRIEF DESCRIPTION OF THE DRAWINGS

The present invention will be more clearly understood from the description as set forth below with reference to the accompanying drawings, wherein:

FIGS. 5A and 5B show tables of reference values to test a skew, stored in a memory of FIG. 4;

DESCRIPTION OF THE PREFERRED EMBODIMENTS

Before describing the preferred embodiments, an explanation will be given of the conventional cut sheet feeding device having a function of detecting a skew of the sheet to be fed shown in FIGS. 1 to 3.

As an example of the cut sheet feeding device, an image scanner 10 connected to a personal computer 20 will be explained. The essential parts of the image scanner 10 and personal computer 20 are the same between the present invention and the prior art. The essential parts of the image scanner 10 and personal computer 20 will be explained first, and then a skew detecting technique of the prior art applied to the image scanner 10 will be explained.

Figure 1:
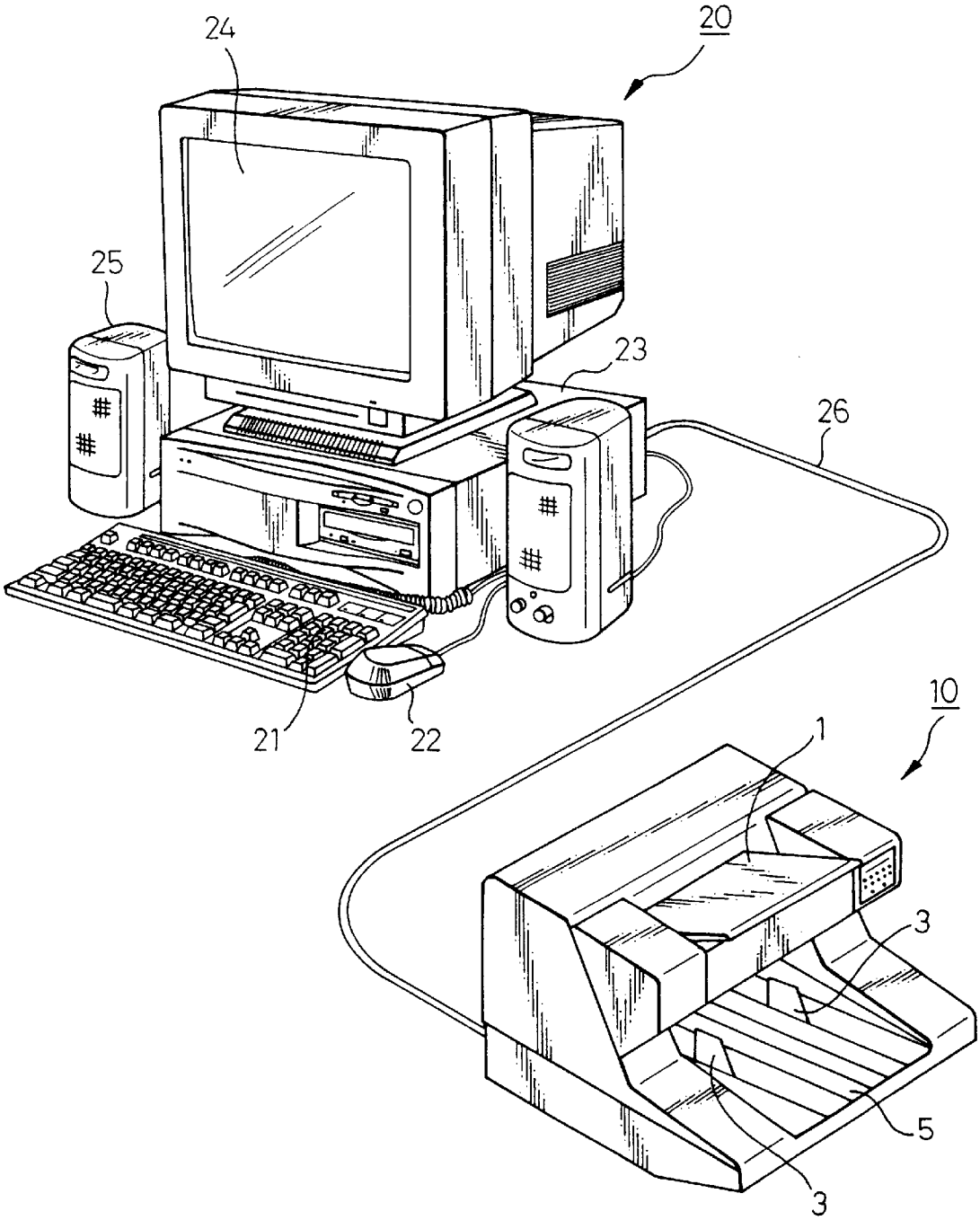
FIG. 1 is a perspective view showing an image scanner incorporating a cut sheet feeding device having a function of detecting a skew of the sheet to be fed, according to an embodiment of the present invention, and a personal computer connected to the image scanner.

In FIG. 1, the personal computer 20 consists of a computer proper 23, a display 24, and speakers 25 for voice output. The personal computer 20 has input devices such as a keyboard 21 and a mouse 22 and a data processing function. The computer 23 may have floppy disk drives, memory cards, and external storage devices such as CD-ROM drives.

The image scanner 10 is connected to the personal computer 20 through an I/O cable consisting of RS232C and video cables, or a SCSI cable. The image scanner 10 has a hopper 5 for holding documents to be read, sheet guides 3 adjustable according to the size of the documents, and a stacker 1 for stacking discharged documents that have been read.

Figure 2A:
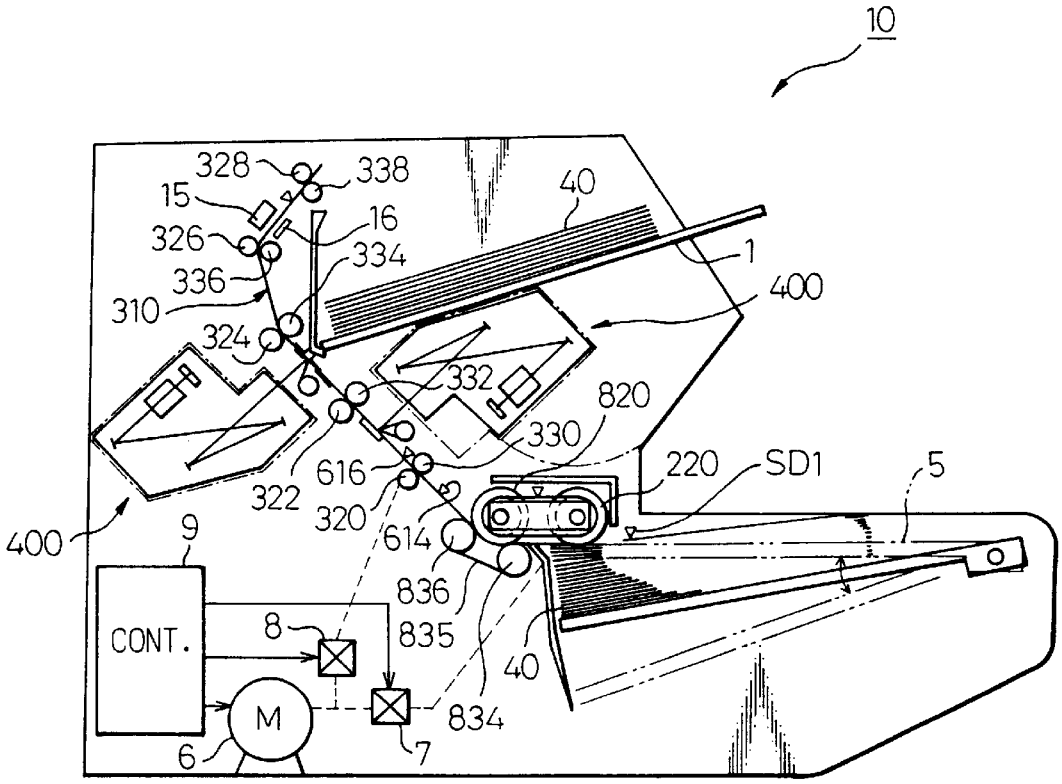
FIG. 2A is a vertical section showing the internal structure of the image scanner of FIG. 1.

FIG. 2A is a vertical section showing the internal structure of the image scanner 10 of FIG. 1. The FIG. shows, in particular, a path for feeding a document. The hopper 5 holds documents 40, and a stacker 1 stacks documents 40 that have been read. A picking roller 220 guides the documents 40 one after another from the hopper 5 to a feeding path 310. A separation roller 820 cooperates with a belt 835 stretched around pulleys 834 and 836, to surely separate the document sent from the picking roller 220 to the feeding path 310. The feeding path 310 is provided with feed roller pairs 310 and 330, 322 and 332, 324 and 334, 326 and 336, and 328 and 338. The feed roller pairs, picking roller 220, and separation roller 820 are driven by a feed motor 6.

The motor 6 is a step motor whose rotation speed is determined according to the number of pulses applied thereto.

The picking roller 220 is connected to the step motor 6 through a first clutch 7, which changes a transmission of the driving force of the step motor 6 to the picking roller 220. The feed roller 320 is connected to the step motor 6 through a second clutch 8, which changes a transmission of the driving force of the step motor 6 to the feed roller 320. The clutches 7 and 8 and step motor 6 are controlled by a controller 9. The controller 9 changes the clutches 7 and 8 to control the rotations of the picking roller 220 and feed roller 320.

A reader 400 has image sensors to read data from the document 40 that passes in front of the reader 400. The reader 400 is arranged on each side of the feeding path 310, to simultaneously read data from the front and back faces of the document 40. Since the reader 400 is not particularly related to the present invention, its structure will not be explained.

There are a document sensor 614 and a read timing sensor 616. The details of these sensors will be explained later. The image scanner 10 may have an ink-jet type printing device 15 along the feeding path 310 between the roller pair 326 and 336 and the roller pair 328 and 338, as well as a pad 16 in front of the printing device 15. These elements enable the image sensor 10 to serve as a printer. Namely, the present invention is applicable to a printer having a function of feeding cut sheets.

Figure 2B:
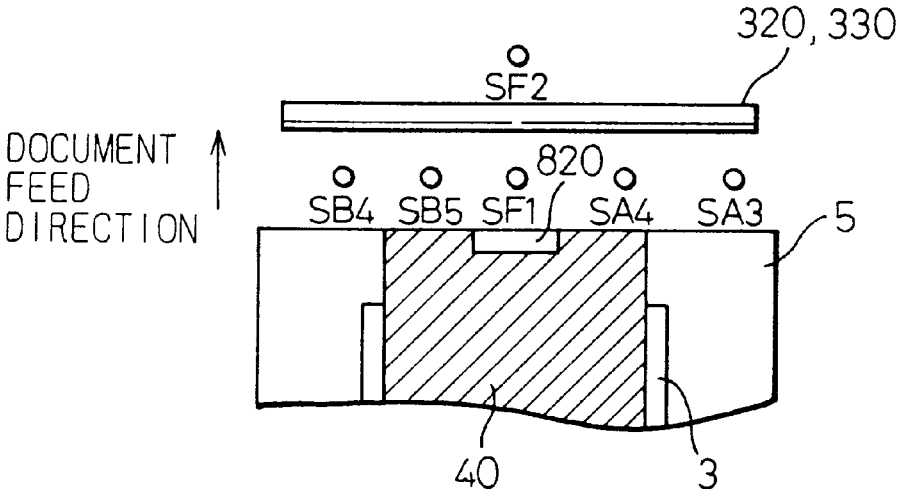
FIG. 2B is a plan view showing size sensors of the image scanner of FIG. 2A.

FIG. 2B is a plan view showing the document feeding zone and, in particular, the positions of the feed roller 320 (330), separation roller 820, and sensors of the image scanner 10 of FIG. 2A.

The hopper 5 holds the documents 40 to be fed to the readers 400. The documents 40 are guided by the sheet guides 3. The picking roller 220 (not shown in FIG. 2B) picks up the documents 40 one by one from the hopper 5. A given document 40 is fed by the separation roller 820, is passed over the sensors, and is carried by the feed rollers 320 and 330.

The document 40 is carried in the scanner 10 with the center of the scanner 10 serving as a reference line, and therefore, the separation roller 820 is arranged on the center line.

The document sensor SF1 determines whether or not the document 40 has normally been picked from the hopper 5. The document sensor SF1 is arranged on the center line of the scanner 10. Any document detected by the document sensor SF1 is determined to be being fed normally. The read timing sensor SF2 is spaced away from the feed rollers 320 and 330 by a predetermined distance and determines the timing of reading the document 40. When the read timing sensor SF2 detects the leading edge of the document 40, a timer (not shown) starts to count the feeding time of the document 40 so that the document 40 is read when the leading edge of the document 40 reaches the readers 400.

A size sensor SA4 detects an A4-size document. A size sensor SA3 detects an A3-size document. A size sensor SB4 detects a B4-size document. A size sensor SB3 detects a B3-size document. These size sensors detect the width of the document 40 passing over the sensors and determine the size of the document.

For example, if the size sensor SA4 is ON and the size sensors SA3 and SB4 for sizes larger than A4 are OFF, the size of the document 40 passing over the sensors is A4.

The document sensor SF1 and size sensors SA4, SA3, SB5, and SB4 are arranged along a single straight line that is orthogonal to a document feeding direction. If the document 40 has no skew, the sensors simultaneously detect the leading edge of the document. The document and size sensors may be optical sensors such as transmission sensors or reflection sensors.

Figure 3A:
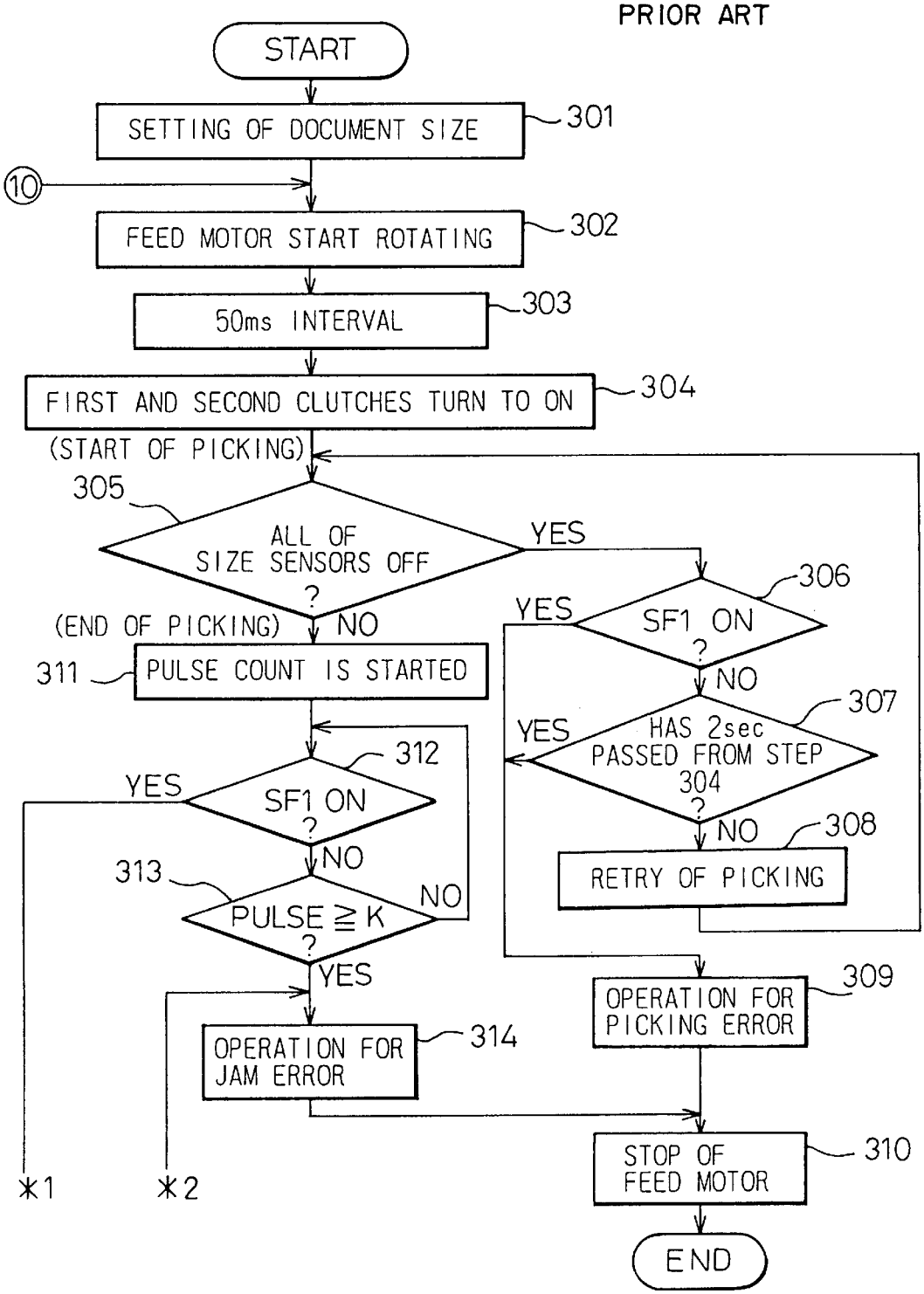
Fig. 3A PRIOR ART
FIGS. 3A and 3B are a flowchart showing the steps of detecting a skew according to a prior art.
Figure 3B:
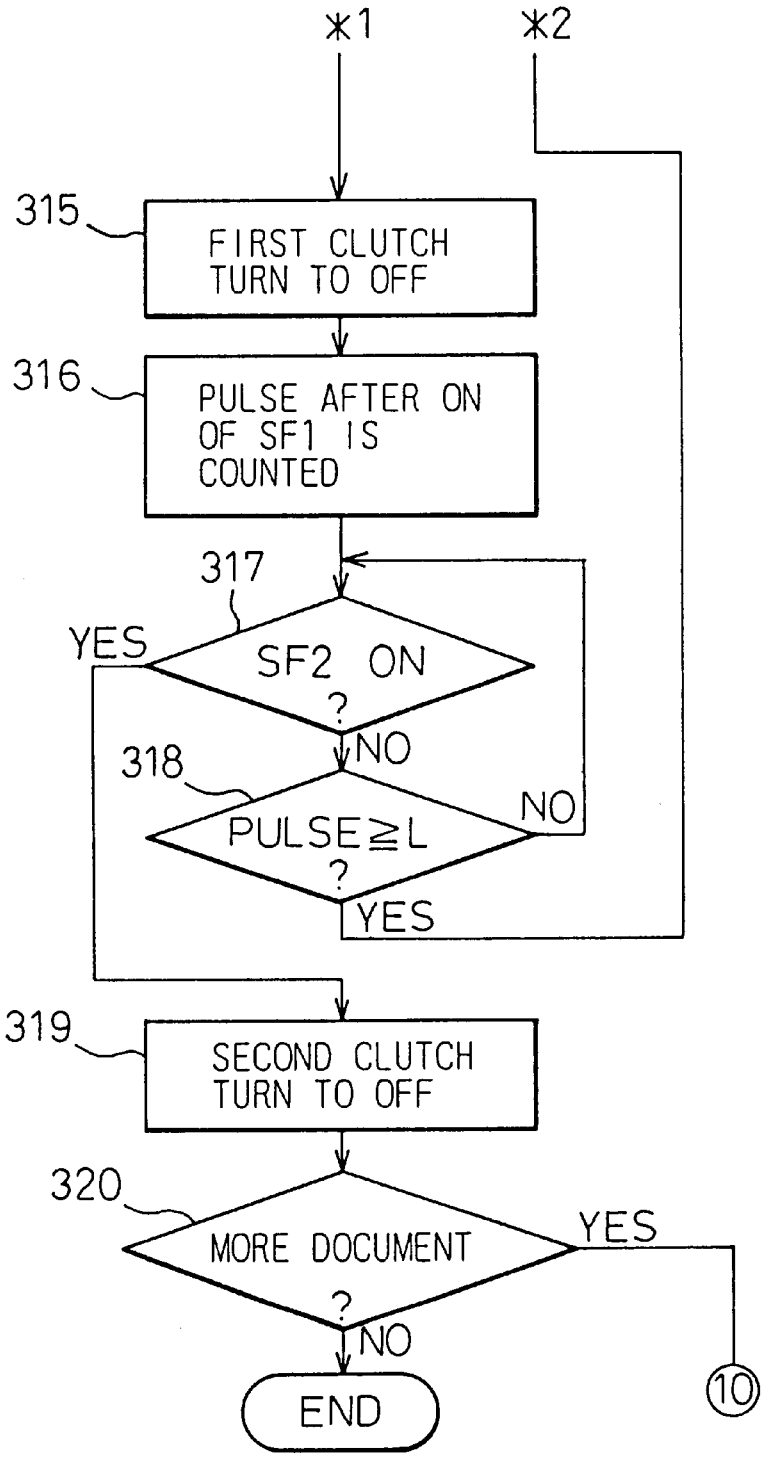
Fig.3B PRIOR ART

FIGS. 3A and 3B are flowcharts showing the steps of picking and feeding a document in the image sensor 10 according to the prior art.

An operator sets a document size in step 301. Step 302 starts the step motor 6 for driving the feed rollers, etc. Step 303 sets an interval of 50 ms after the start of the step motor 6. After 50 ms, step 304 turns on the first and second clutches 7 and 8 to drive the picking roller 220, separation roller 820, and feed rollers 320 and 330.

After the first document 40 is picked, step 305 determines whether or not any one of the four size sensors SA4, SA3, SB5, and SB4 is ON, to determine if the document 40 has been detected. If none of the size sensors has detected the document 40, the control proceeds to step 306.

Step 306 checks to see if the document sensor SF1 has detected the document 40. If it has detected no document, step 307 determines whether or not two seconds have passed after the picking of the document 40. If two seconds have not passed, step 308 retries the pickup operation of the document 40 at intervals of 0.5 seconds.

If step 307 determines that two seconds have passed after the execution of step 304, there is an abnormality in picking the document 40. Accordingly, step 309 carries out a picking error operation, and step 310 stops the step motor 6. Then, the routine ends. In this case, the operator repeats the pickup operation of the document 40.

If the document sensor SF1 detects the document 40 in step 306, there is an abnormality in the feeding system because none of the size sensors SA4, SA3, SB5, and SB4 has detected the document 40 in step 305. Accordingly, step 309 carries out the picking error operation.

If any one of the size sensors detects the document 40 in step 305, it is determined that the document 40 has successfully been picked up, and step 311 starts to count the number of pulses applied to the step motor 6 after the detection of the document 40 by the size sensor. Step 312 determines whether or not the document sensor SF1 has detected the document 40. If not, step 313 checks to see if the number of pulses counted in step 311 is larger than a reference value K. If the document 40 is normally being fed, the document sensor SF1 detects the document 40 at the time when, or a little after the size sensor detected the document 40. Accordingly, the number of pulses is counted after the size sensor detects the document 40 until the document sensor SF1 detects the document 40, and the pulse count is compared with the reference value K, to determine whether or not the document 40 is being correctly fed.

If the pulse count is larger than K in step 313, the document 40 is not fed, and step 314 carries out a jam error operation. If the pulse count is below K in step 313, the control returns to step 312.

If the document sensor SF1 is ON in step 312 to indicate the detection of the document 40, step 315 turns off the first clutch 7 to stop the picking roller 220. Step 316 counts the number of pulses applied to the step motor 6 after the detection of the document 40 by the document sensor SF1. Step 317 determines whether or not the read timing sensor SF2 is ON to indicate the detection of the document 40.

If the read timing sensor SF2 is ON in step 317, the document 40 is being normally fed. Accordingly, step 319 turns off the second clutch 8, and step 320 checks to see if there is any document left in the hopper 5. If there is no document, the routine ends. If there is any document, the control returns to step 302 to pick up the next document.

If step 317 determines that the read timing sensor SF2 is OFF, step 318 checks to see if the number of pulses counted in step 316 is above a reference value L. If the pulse count is above L, step 314 carries out the jam error operation. If the pulse count is below L, step 317 again tests if the read timing sensor SF2 is ON.

A skew of the document 40 in the image scanner 10 is displayed as an inclination of the image of the document 40 on the display 24. According to the prior art, the operator must examine the inclination of the image and determine whether or not the document 40 is skewed.

Figure 2C:
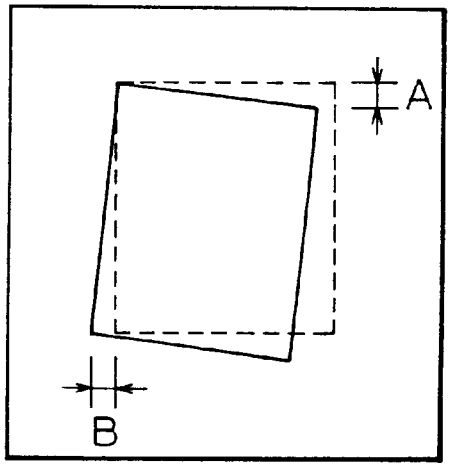
FIG. 2C explains a conventional skew detecting method that must check each document on a display.

FIG. 2C shows a document displayed, on the display 24, to determine if the document is skewed according to the prior art. A dotted line in FIG. 2C indicates a document having no skew, and a continuous line indicates a document that is skewed.

In FIG. 2C, a reference mark "A" indicates a skew in the main scanning direction, i.e., a gap between the left and right ends of the leading edge of the document, and "B" indicates a skew in the secondary scanning direction, i.e., a gap between the front and rear ends of the left edge of the document.

According to the prior art, the operator must examine the ratio of the value A to the width of the document as well as the ratio of the value B to the length of the document. If each of the values A and B is less than one percent of the corresponding document length, it is determined that the document is normally being fed. If any one of the values A and B exceeds the corresponding document length, it is determined that the document is abnormally skewed.

According to the prior art, the operator must check, on the display, the gaps in the main and secondary scanning directions for each document that it is read and displayed. This is quite laborious for the operator.

The document reading speed of recent image scanners is very high, and therefore, it is very difficult for the operator to check every document for skew. Even if the operator finds a skew in one document, it is impossible for the operator to quickly carry out an error operation on such a high-speed image scanner.

Next, the novel structure of a cut sheet feeding device according to an embodiment of the present invention will be explained. This embodiment is applied to the image scanner 10 and personal computer 20 of FIGS. 1, 2A, and 2B.

Figure 4:
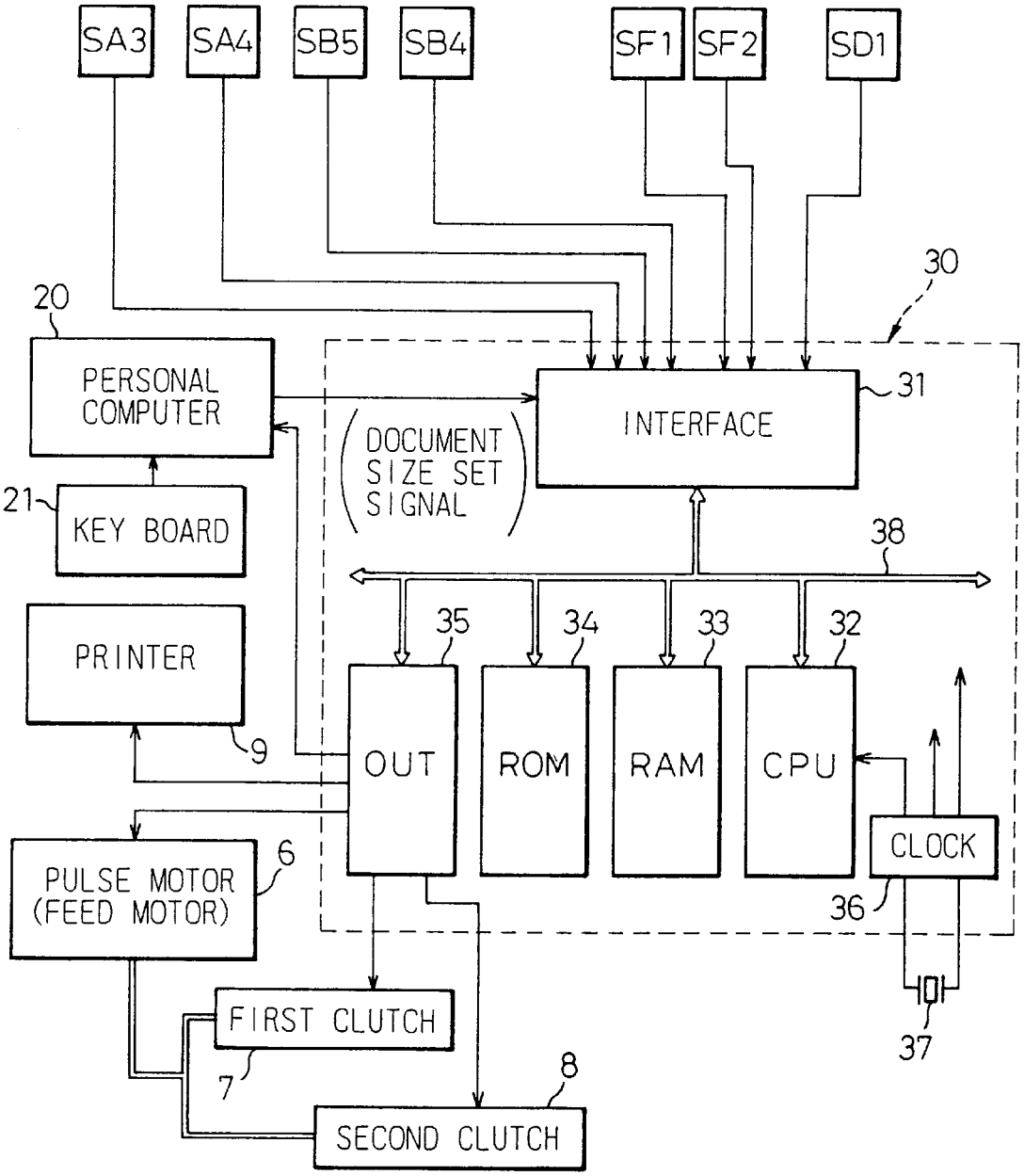
FIG. 4 is a block diagram showing an internal control circuit of the cut sheet feeding device of the present invention of FIG. 1.

FIG. 4 is a block diagram showing a control circuit 30 according to the present invention incorporated in the image scanner 10.

The control circuit 30 has an interface 31 for receiving various signals, a central processing unit (CPU) 32, a random access memory (RAM) 33, a read-only memory (ROM) 34, and an output circuit 35. These parts are connected to one another through a bus 38. The control circuit 30 has a clock generator 36 for generating a reference clock signal according to the oscillation of a crystal 37.

The interface 31 receives signals from the size sensors SA3, SA4, SB5, and SB4, document sensor SF1, read timing sensor SF2, and remaining document sensor SD1 installed on the hopper 5, as well as a document size setting signal from the personal computer 20. The document size may be entered through the keyboard 21 of the personal computer 20 and supplied to the interface 31. Instead, the image scanner 10 may have a document size setting button to set a document size. In this case, the document size setting signal is entered from the image scanner 10. The RAM 33 temporarily stores various data, and the ROM 34 stores programs, a reference skew table to be explained later, etc. The output circuit 35 is connected to the step motor 6, printer 9, first clutch 7, second clutch 8, and personal computer 20.

After a document size is set through the keyboard 21, the CPU 32 detects a skew or jam of each document according to signals from the size sensors SA3, SA4, SB5, and SB4, document sensor SF1, and read timing sensor SF2, and provides the personal computer 20 with the detected situation through the output circuit 35. According to the signal from the control circuit 30 of the image scanner 10, the personal computer 20 displays the skewing or jamming state of the document. The CPU 32 calculates the fed distance of a document according to the number of pulses applied to the step motor 6 and finds a skew of the document according to the fed distance and the signals from the size and document sensors.

The ROM 34 stores a table of reference values that are used by the CPU 32 to determine whether or not a document is skewed.

FIG. 5A shows an example of the table that contains allowable skews. Values shown in this table are the movements of a document from the size sensors SA3 to SB5 to the document sensor SF1. Any cell of the table having no value corresponds to a size larger than a set size. If a size sensor for detecting a size larger than a set size is turned on, this embodiment immediately determines that the document is skewed without calculating a skew. Accordingly, there is no allowable skew in each cell corresponding to a size larger than a set size.

Figure 6A:
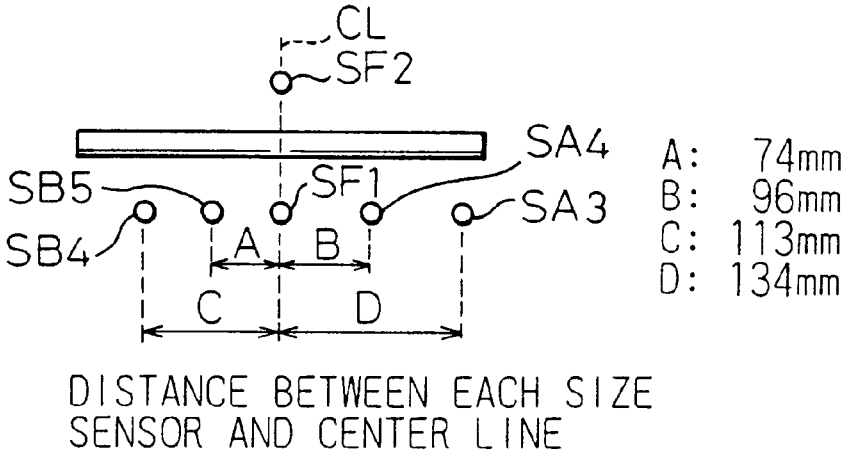
FIG. 6A shows distances from the size sensors of FIG. 2B to a center line.

A method of calculating the allowable skews of FIG. 5A will be explained with reference to FIGS. 6A and 6B. FIG. 6A shows examples of the distances between the document sensor SF1 and the size sensors SA3, SA4, SB5, and SB4. For example, the distance "A" between the document sensor SF1 and the size sensor SB5 is 74 mm, the distance "B" between the sensors SF1 and SA4 is 96 mm, the distance "C" between the sensors SF1 and SB4 is 113 mm, and the distance "D" between the sensors SF1 and SF3 is 134 mm.

Figure 6B:
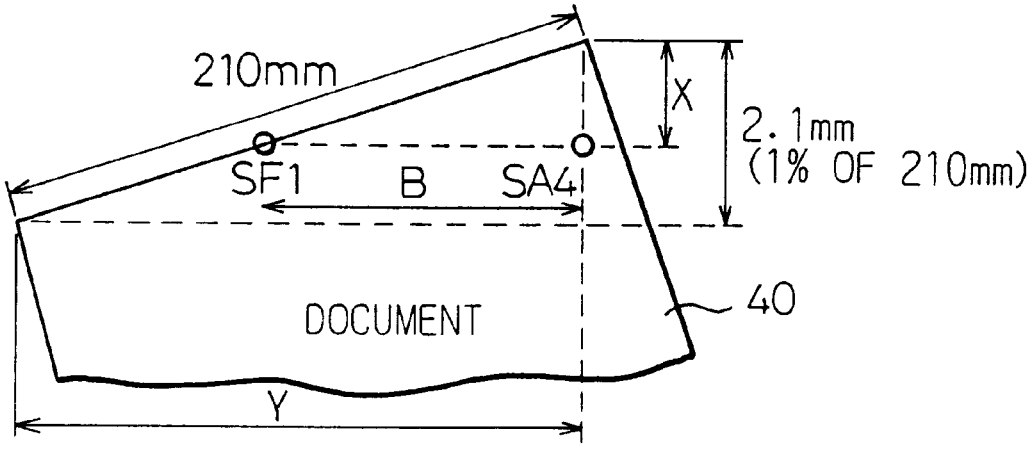
FIG. 6B explains a method of calculating a reference skew with the size sensors of FIG. 6A.

FIG. 6B explains the calculation of a skew in a A4-size document 40 when the size sensor SA4 for size A4 is first turned on. The width by length of the A4-size document 40 is 210 mm×297 mm. An allowable skew is plus/minus one percent of the width of the A4-size document 40 of 210 mm. This means that an allowable gap between the right and left shoulders of the leading edge of the document 40 is 2.1 mm.

In this case, the distance Y between the left and right ends of the leading edge of the document 40 is expressed as follows:

$$Y=(210^2-2.1^2)^{1/2} \quad (1)$$

The distance B between the document sensor SF1 and the size sensor SA4 and the distance X between the right end of the leading edge of the document and the position of the sensors are as follows:

$$Y:B=2.1:X \quad (2)$$

Accordingly, X is as follows:

$$X=B\times 2.1/Y \quad (3)$$

Since B is 96 mm as explained above and Y is about 209.99 mm according to the expression (1), X is about 0.96 mm, which serves as an allowable skew.

If a feed of the document is less than 0.96 mm after the size sensor SA4 detects the A4-size document 40 until the document sensor SF1 detects the same document, it is determined that the document has no skew. If the feed is over 0.96 mm, it is determined that the document is skewed, and an error operation is carried out.

An allowable skew for each document size is set in advance, and the distance between the document sensor SF1 and each size sensor is fixed. Accordingly, an allowable document feed for each document size with respect to each size sensor is calculated in advance according to the distance between the document sensor SF1 and the size sensor and is stored in the table of FIG. 5A.

In this way, an allowable skew is calculated for each document size and for each size sensor and is stored in the table in the ROM 34. An allowable skew in the table corresponding to a set document size is compared with an actual document feed from when a corresponding one of the size sensors detects a document up to when the document sensor SF1 detects the same document, to immediately detect an abnormal feed, if any.

In this way, the present invention compares the actual skew of a document with an allowable skew stored in the table, to determine whether or not the document is skewed. The present invention carries out the skew detecting operation at high speed because there is no need of calculating the skew of every document.

When the reading density of the image scanner 10 is 200 dpi (dot per inch) and when the step motor 6 feeds a document by one dot in response to a pulse supplied to the step motor 6, the number of pulses applied to the step motor 6 may be detected to calculate the feed of the document. A reading density of 200 dpi corresponds to a feed of 0.127 mm per dot. In this case, the allowable skew of 0.96 mm for an A4-size document with respect to the size sensor SA4 corresponds to about 7.6 dots. Namely, eight dots are just above the allowable skew.

If the number of pulses applied to the step motor 6 is equal to or smaller than seven after the size sensor SA4 detects the A4-size document 40 until the document sensor SF1 detects the same document, it is determined that the document is being fed normally. If the pulse count is equal to or greater than eight, it is determined that the document is abnormally skewed, and an error operation is carried out.

The table of allowable skews in distances of FIG. 5A is converted into the table of FIG. 5B that shows the allowable skews in dots for an image scanner having a reading density of 200 dpi. A proper one of the numbers of dots (the numbers of pulses applied to the step motor 6) stored in the table in ROM 34 is compared with the number of actual pulses applied to the step motor 6, to quickly detect an abnormal feed of document, if any.

Alternatively, a document feed may be found according to a period between the passage of the document past a corresponding size sensor and the passage of the same document past the document sensor SF1.

A case (a) when a document is normally being fed, a case (b) when a document is apparently skewed, and a case (c) when the skew of a document is evaluated in the image scanner 10 will be explained.

(a) Document being normally fed

Figure 7A:
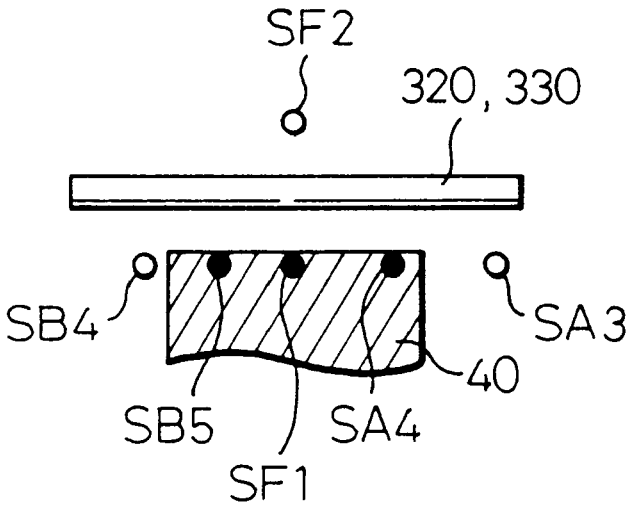
FIG. 7A shows the states of the size sensors and a document sensor with a document being normally fed into the image scanner.
Figure 7B:
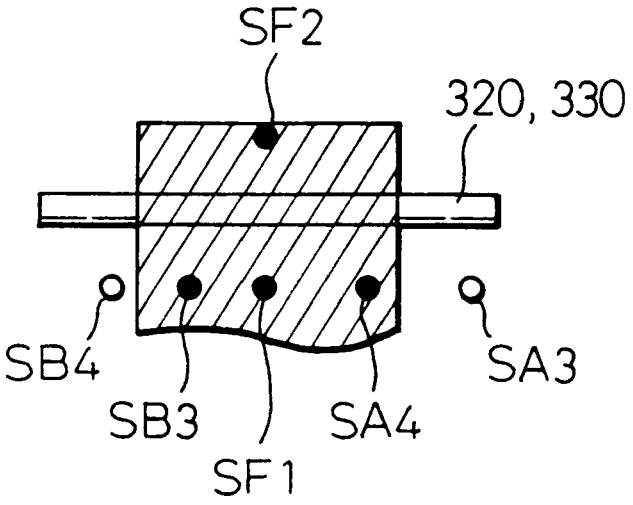
FIG. 7B shows the document of FIG. 7A fed to a read timing sensor.

FIG. 7A shows the operations of the size sensors SB4, SB5, SA4, and SA3 and the document sensor SF1 when an A4-size document 40 is being fed normally in the image scanner 10. FIG. 7B shows the document 40 fed up to the read timing sensor SF2 from the state of FIG. 7A.

In the following drawings, a black dot indicates a sensor that is ON, and a white dot indicates a sensor that is OFF. Due to the sheet guides 3 of FIG. 2B, the document 40 will never entirely be shifted to the right or left side of the document sensor SF1.

When the A4-size document 40 is being fed normally, the document sensor SF1 and size sensors SA4 and SB5 under the document 40 are simultaneously turned on as shown in FIG. 7A. In this case, the document 40 is not skewed, and therefore, the document 40 is continuously fed. After a predetermined time, the leading edge of the document 40 reaches the read timing sensor SF2 as shown in FIG. 7B. At this timing, the readers 400 (FIG. 2A) read image data from the document 40.

(b) Document apparently skewing

Figure 8A:
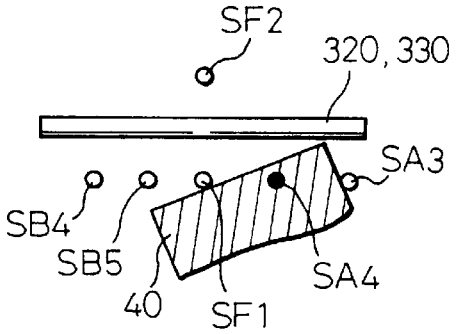
FIG. 8A is an explanatory view showing a document greatly skewed and fed into the image scanner with the right shoulder of the document being fed first to turn on one of the size sensors.
Figure 8C:
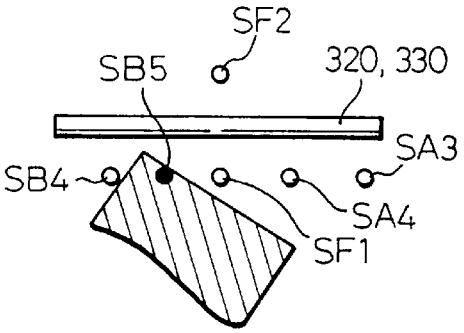
FIG. 8C is an explanatory view showing a document greatly skewed and fed into the image scanner with the left shoulder of the document being fed first to turn on one of the size sensors.
Figure 8B:
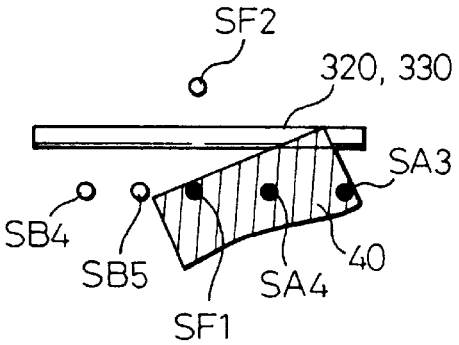
FIG. 8B is an explanatory view showing the document of FIG. 8A further fed into the image scanner to turn on more of the size sensors as well as the document sensor.
Figure 8D:
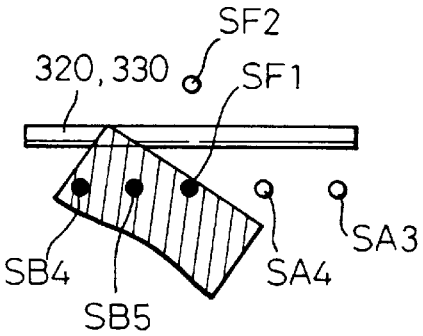
FIG. 8D is an explanatory view showing the document of FIG. 8C further fed into the image scanner to turn on more of the size sensors as well as the document sensor.

FIGS. 8A and 8B show the operations of the size sensors SB4, SB5, SA4, and SA3 and document sensor SF1 when the A4-size document 40 is largely skewed with the right shoulder thereof being higher than the left shoulder of the same. FIGS. 8C and 8D explain the operations of the size and document sensors when the A4-size document 40 is largely skewed with the left shoulder thereof being higher than the right shoulder of the same.

When the document 40 is skewed as shown in FIG. 8A, the size sensor SA4 is first turned on to detect the leading edge of the document 40. If the document 40 is continuously fed under this state, the document sensor SF1 and size sensor SA3 are turned on after a predetermined time as shown in FIG. 8B.

Since the size of the document 40 is A4 and the size sensor SA3 is for A3, it is understood that a size sensor for a document size larger than the set document size has been turned on. This occurs only when the document 40 is greatly skewed.

When the document 40 is skewed as shown in FIG. 8C, the size sensor SB5 is first turned on to detect the leading edge of the document 40. If the document 40 is continuously fed under this state, the document sensor SF1 and size sensor SB4 are turned on after a predetermined time as shown in FIG. 8D.

Since the size of the document 40 is A4 and the size sensor SB4 is for B4, it is understood that a size sensor for a document size larger than the set document size has been turned on. This occurs only when the document 40 is greatly skewed.

In FIGS. 8B and 8D, the size sensors SA3 and SB4, which should never detect an A4-size document, have detected the document, and therefore, the image scanner 10 determines that an abnormality has happened in feeding the document 40 and carries out an error operation. In this case, it is very possible that the document is skewed out of an allowable range, and therefore, there is no need of calculating the skew of the document 40 according to the distance "X" mentioned above. Consequently, the skew of the document 40 is not calculated.

(c) Skew of document being evaluated

Figure 9A:
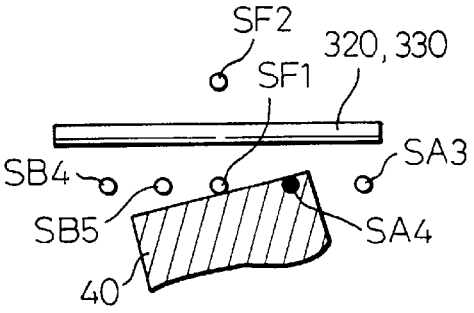
FIG. 9A is an explanatory view showing a document skewed and fed into the image scanner with the right shoulder of the document being fed first to turn on one of the size sensors.
Figure 9C:
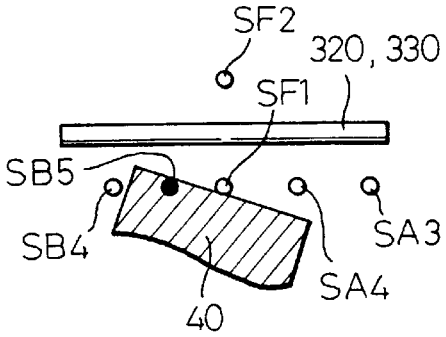
FIG. 9C is an explanatory view showing a document skewed and fed into the image scanner with the left shoulder of the document being fed first to turn on one of the size sensors.
Figure 9B:
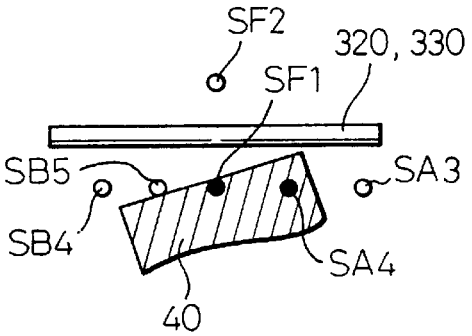
FIG. 9B is an explanatory view showing the document of FIG. 9A further fed into the image scanner to turn on the size sensor and document sensor.
Figure 9D:
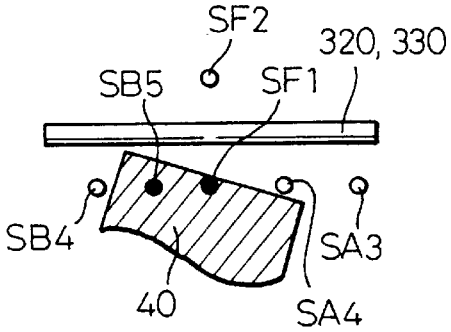
FIG. 9D is an explanatory view showing the document of FIG. 9C further fed into the image scanner to turn on the size sensor and document sensor.

FIGS. 9A and 9B show the operations of the size sensors SB4, SB5, SA4, and SA3 and document sensor SF1 when the A4-size document 40 is skewed with the right shoulder thereof being higher than the left shoulder of the same. FIGS. 9C and 9D show the operations of the size and document sensors when the A4-size document 40 is skewed with the left shoulder thereof being higher than the right shoulder of the same.

When the document 40 is skewed as shown in FIG. 9A, the size sensor SA4 is first turned on to detect the leading edge of the document 40. If the document 40 is continuously fed under this state, only the document sensor SF1 is turned on after a predetermined time determined by the degree of the skew of the document, as shown in FIG. 9B.

When the document 40 is skewed as shown in FIG. 9C, the size sensor SB5 is first turned on to detect the leading edge of the document 40. If the document 40 is continuously fed under this state, only the document sensor SF1 is turned on after a predetermined time determined by the degree of the skew of the document, as shown in FIG. 9D.

Namely, the size sensor SA4 corresponding to the set document size or the size sensor SB5 corresponding to a size narrower than the set document size is ON. In these cases, the number of pulses applied to the step motor 6 is counted after the first size sensor is turned on until the document sensor SF1 is turned on, and the pulse count is compared with a reference value stored in the table of FIG. 5B. If the pulse count is equal to or greater than the reference value, it is determined that the document 40 is skewed, and if the pulse count is smaller than the reference value, it is determined that the document 40 is normal. The skew may be calculated according to the difference between the time when the document passes the size sensor and the time when the same passes the document sensor, and the set document size.

Figure 10A:
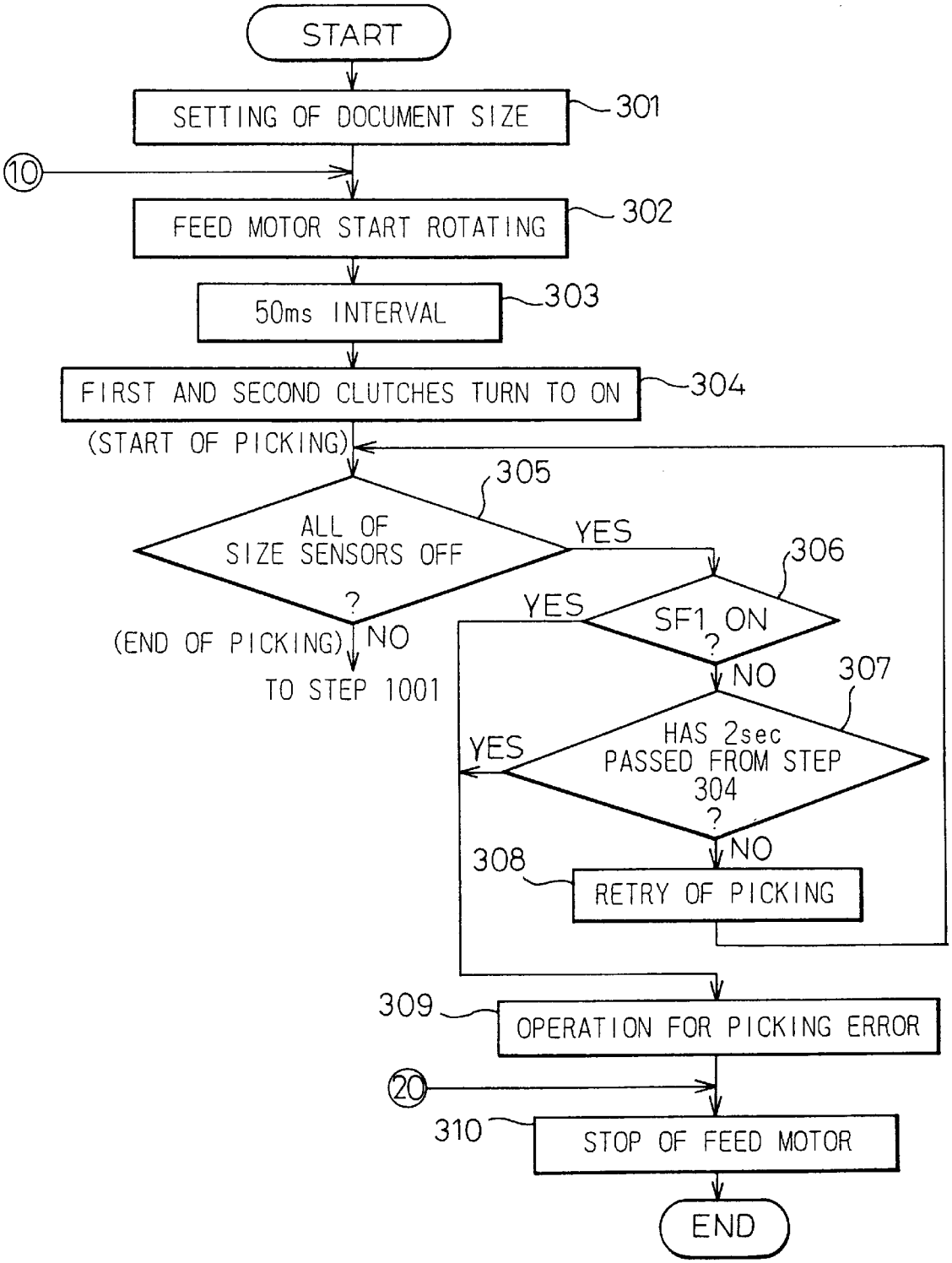
FIGS. 10A to 10C are flowcharts showing the steps of feeding a document and detecting a skew of the document in the image scanner according to the present invention.
Figure 10B:
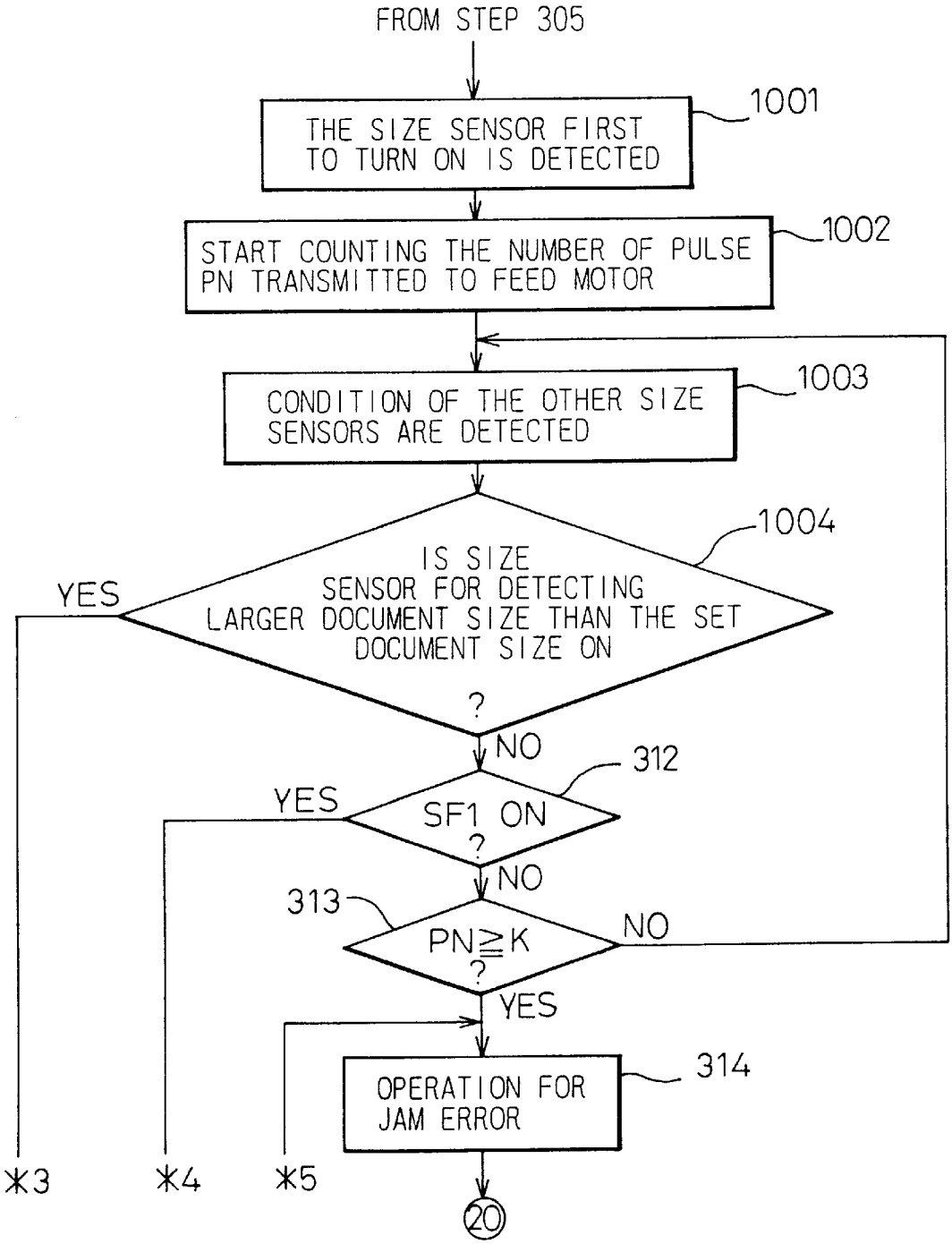
Figure 10C:
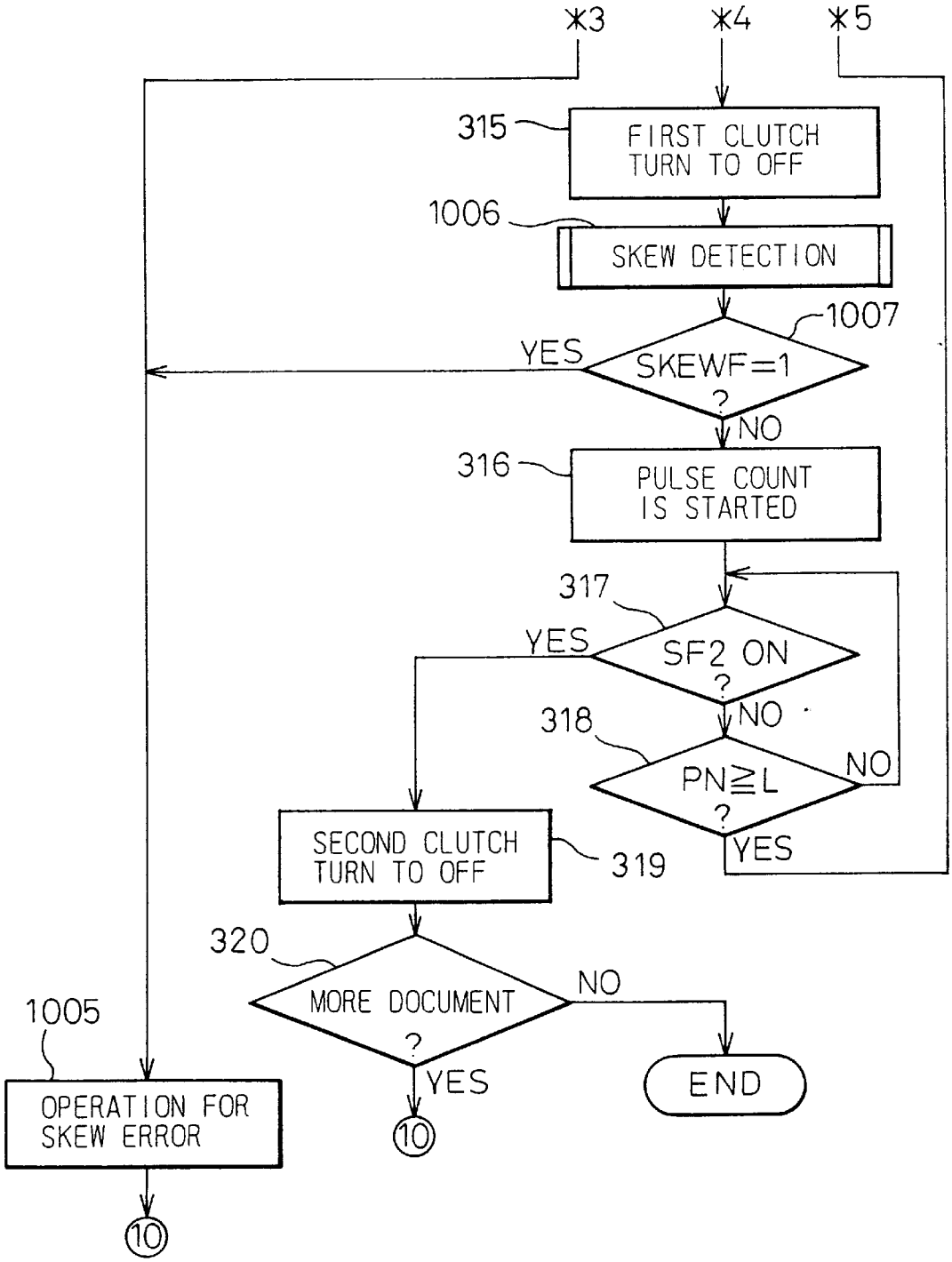
Figure 11:
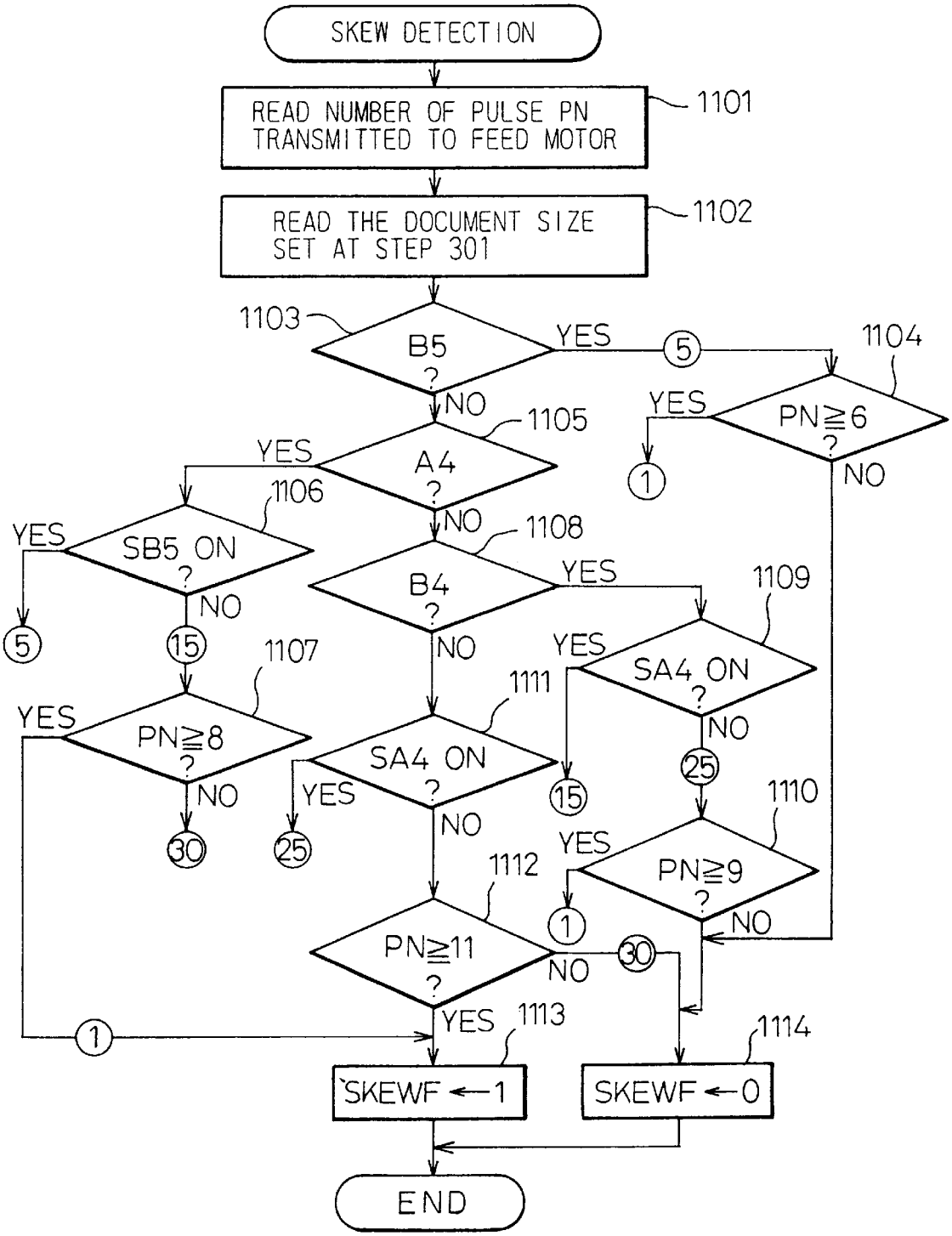
FIG. 11 is a flowchart showing the details of the skew detecting step of FIG. 10C.

FIGS. 10A to 10C are flowcharts showing the steps of feeding a document and detecting a skew of the document in the image scanner 10 having the skew detecting function mentioned above. For the sake of simplicity, the same steps as those of the prior art of FIG. 3 are represented with like numbers. FIG. 11 is a flowchart showing the details of skew detecting step 1006 of FIG. 10B.

[0038–39]→[0005]

An operator sets a document size in step 301. Step 302 starts the step motor 6 for driving the feed rollers, etc. Step 303 sets an interval of 50 ms after the start of the step motor 6. After 50 ms, step 304 turns on the first and second clutches 7 and 8 to drive the picking roller 220, separation roller 820, and feed rollers 320 and 330.

After the first document 40 is picked, step 305 determines whether or not any one of the four size sensors SA4, SA3, SB5, and SB4 is ON, to determine if the document 40 has been detected. If none of the size sensors has detected the document 40, the control proceeds to step 306.

Step 306 checks to see if the document sensor SF1 has detected the document 40. If it has not detected a document, step 307 determines whether or not two seconds have passed after the picking of the document 40. If two seconds have not passed, step 308 retries the pickup operation of the document 40 at intervals of 0.5 seconds.

If step 307 determines that two seconds have passed after the execution of step 304, there is an abnormality in picking the document 40. Accordingly, step 309 carries out a picking error operation, and step 310 stops the step motor 6. Then, the routine ends. In this case, the operator repeats the pickup operation of the document 40.

If the document sensor SF1 detects the document 40 in step 306, there is an abnormality in the feeding system because none of the size sensors SA4, SA3, SB5, and SB4 has detected the document 40 in step 305. Accordingly, step 309 carries out the picking error operation.

If any one of the size sensors detects the document 40 in step 305, the document 40 has successfully been picked up, and step 1001 detects and stores the size sensor that has first been turned on. Step 1002 starts to count the number PN of pulses applied to the step motor (feed motor) 6 after the size sensor detects the document. At this moment, step 1003 detects and stores the ON/OFF states of the other size sensors.

Step 1004 determines whether or not a size sensor for a size larger than the document size set in step 301 is ON. If such a size sensor is ON, the document is not being normally fed and is greatly skewed. Accordingly, step 1005 carries out a skew error operation to temporarily stop the step motor 6 and return to step 302 to repeat the pickup operation.

If step 1004 determines that no size sensors for larger sizes are ON, step 312 determines whether or not the document sensor SF1 has detected the document 40. If not, step 313 checks to see if the number PN of pulses is larger than a reference value K.

If PN<K, the control returns to step 1003. If PN >=K, the document 40 is jammed so that step 314 carries out a jam error operation, and step 310 stops the step motor 6. Then the routine ends.

If the document sensor SF1 is ON in step 312 to indicate the detection of the document 40, step 315 turns off the first clutch 7 to stop the picking roller 220 from picking up a document from the hopper 5. Step 1006 detects a skew of the document 40. As explained above, the table of FIG. 5A or 5B is looked-up according to the set document size and the size sensor that has first detected the document, and it is determined whether or not a feed (the number of pulses, an elapsed time, etc.,) from when the size sensor detects the document until when the document sensor SF1 detects the document is within the allowable range of plus/minus one percent. This skew detecting process will be explained later with reference to FIG. 11. If the skew is out of the allowable range, a skew flag SKEWF is set to 1, and if the skew is within the allowable range, the skew flag SKEWF is set to 0.

After the skew detecting process of step 1006, step 1007 checks to see if SKEWF=1. If SKEWF=1, step 1005 carries out the skew error operation.

If SKEWF=0, the document 40 has no skew, and step 316 counts the number of pulses applied to the step motor 6 after the detection of the document 40 by the document sensor SF1. Step 317 determines whether or not the read timing sensor SF2 is ON to indicate the detection of the document 40.

If the read timing sensor SF2 is ON in step 317, the document 40 is being fed normally. Accordingly, step 319 turns off the second clutch 8 to stop the feed roller 320. Since the other feed rollers 322, 324, 326, and 328 are independent of the feed roller 320, the document 40 is continuously fed by these rollers. Step 320 checks to see if there is any document left in the hopper 5. If there is no document, the routine ends. If there is any document, the control returns to step 302 to pick up the next document.

If step 317 determines that the read timing sensor SF2 is OFF, step 318 checks to see if the number PN of pulses counted in step 316 is above a reference value L. The reference value L corresponds to the number of pulses necessary for feeding the document 40 from the document sensor SF1 to the read timing sensor SF2. If PN>=L, the document 40 has jammed between the document sensor SF1 and the read timing sensor SF2, and step 314 carries out the jam error operation. If PN<L, the control returns to step 317 to determine whether or not the read timing sensor SF2 has detected the document 40.

The skew detecting process will be explained in detail with reference to FIG. 11. Step 1101 reads the number PN of pulses applied to the step motor 6. Step 1102 reads the document size set in step 301.

Step 1103 determines whether or not the set document size is B5. If it is B5, step 1104 compares the number PN read in step 1101 with "6" in the table of FIG. 5B for the size sensor SB5 and document size B5. If PN>=6 in step 1104, step 1113 sets the skew flag SKEWF to 1 to indicate that the document 40 is skewed over one percent. If PN<6 in step 1104, step 1114 sets the skew flag SKEWF to 0 to indicate that the document 40 is not skewed over one percent.

In FIG. 6A, the size sensor SB5 is only on the left side of the center line CL. Accordingly, this arrangement is capable of detecting a skew of the document 40 of size B5 only when the left shoulder of the document 40 is higher than the right shoulder thereof. Accordingly, any one of the following two ways must be taken to detect a skew of the document 40 of size B5 with its right shoulder being higher than the left shoulder thereof.

(1) Arranging another size sensor SB5 in symmetry with respect to the center line CL of FIG. 6A (2) Finding the number of pulses applied to the step motor 6 after the size sensor SA4 is turned on until the document sensor SF1 is turned on when the B5-size document 40 is skewed over one percent with its right shoulder being higher than the left shoulder thereof and storing the found pulse number in a cell of the table of FIG. 5B for the size sensor SA4 and document size B5

If step 1103 determines that the set document size is not B5, step 1105 determines whether or not the set document size is A4. If it is A4, step 1106 determines whether or not the size sensor SB5 is ON. If it is ON, the document 40 is skewed with its left shoulder being higher than the right shoulder thereof. Then, step 1104 determines whether or not the skew is over one percent as in the case of the B5-size document.

If step 1106 determines that the size sensor SB5 is OFF, the document 40 is skewed with its right shoulder being higher than the left shoulder thereof. Then, step 1107 compares the number PN read in step 1101 with "8" in the table of FIG. SB for the size sensor SA4 and document size A4. If PN>=8 in step 1107, step 1113 sets the skew flag SKEWF to 1 to indicate that the document 40 is skewed over one percent. If PN<8 in step 1107, step 1114 sets the skew flag SKEWF to 0 to indicate that the document 40 is not skewed over one percent.

If step 1105 determines that the set document size is not A4, step 1108 determines whether or not the set document size is B4. If it is B4, step 1109 determines whether or not the size sensor SA4 is ON. If it is ON, the document 40 is skewed with its right shoulder being higher than the left shoulder thereof. Then, step 1107 determines whether or not the skew is over one percent similar to the A4-size document.

If step 1109 determines that the size sensor SA4 is OFF, the document 40 is skewed with its left shoulder being higher than the right shoulder thereof. Then, step 1110 compares the number PN read in step 1101 with "9" in the table of FIG. 5B for the size sensor SB4 and document size B4. If PN>=9 step 1110, step 1113 sets the skew flag SKEWF to 1 to indicate that the document 40 is skewed over one percent. If PN<9 in step 1110, step 1114 sets the skew flag SKEWF to 0 to indicate that the document 40 is not skewed over one percent.

If step 1108 determines that the set document size is not B4, the set document size is A3. Step 1111 determines whether or not the size sensor SB4 is ON. If it is ON, the document 40 is skewed with its left shoulder being higher than the right shoulder thereof. Accordingly, step 1110 determines whether or not the skew is over one percent similar to the B4-size document.

If step 1111 determines that the size sensor SB4 is OFF, the document 40 is skewed with its right shoulder being higher than the left shoulder thereof. Accordingly, step 1112 compares the number PN read in step 1101 with "11" in the table of FIG. 5B for the size sensor SA3 and document size A3. If PN>=11 in step 1112, step 1113 sets the skew flag SKEWF to 1 to indicate that the document 40 is skewed over one percent. If PN<11 in step 1112, step 1114 sets the skew flag SKEWF to 0 to indicate that the document 40 is not skewed over one percent.

As explained above, the present invention determines that a document is skewed if a detector corresponding to a size larger than a set document size detects the document. There is no need of manually determining whether or not the document is skewed. The present invention is capable of detecting a skew of document even in an apparatus that reads documents at high speed. The present invention is applicable not, only for detecting a skew of document but also for detecting an erroneous setting of document that a set document size is different from the size of a document actually set in an apparatus.

The present invention calculates the skew of a document only when a detector corresponding to a size larger than a set document size does not detect the document. Namely, the present invention does not calculate the skew of a document if the skew is apparent without calculation, thereby improving a skew detecting speed.

The present invention easily calculates the skew of a document according to the number of pulses required by detectors to detect the document. The present invention calculates each allowable skew according to a given document size and the distance between detectors and stores the calculated skews in a table in advance. The table is used to easily find a skew of document without calculation.

What is claimed is:

1. A cut sheet feeding device having a function of detecting a skew of the sheet to be fed, incorporated in a peripheral apparatus that has a mechanism of feeding a document and is connected to a computer having a display, a data input unit, and a data processing unit, comprising:

size detecting means having size sensors that are linearly arranged in a document feeding path orthogonally to a document feeding direction, to detect standard document sizes;

size storing means for storing a document size entered through the data input unit;

comparing means for comparing the document size detected by the size detecting means with the document size stored in the size storing means; and abnormality determination means for determining that an abnormality has occurred in feeding the document if the detected document size is greater than the stored document size, wherein said abnormality is based on an output of one of the size sensors of the size detecting means, said one of the size sensors detecting a larger size than the stored size since the width of the inclined cut sheet in an orthogonal direction of the document feeding path becomes larger than the width of the normally feeding cut sheet.

2. The cut sheet feeding device as claimed in claim 1, wherein the standard document sizes include at least A3, A4, B4, and B5.

3. The cut sheet feeding device as claimed in claim 2, further comprising:

document passage detecting means aligned with the size detecting means on the same straight line and positioned at substantially the center line of a document feeding path, for detecting the passage of a document;

skew calculating means for calculating a skew of the document that is being fed, according to the document size detected by the size detecting means and the passage of the document detected by the document passage detecting means;

allowable skew storing means for storing an allowable skew for each document size;

skew comparing means for comparing, when the abnormality determination means determines that the document is normally being fed, the skew of the document calculated by the skew calculating means with the allowable skew stored in the allowable skew storing means for the document size; and skew determination means for determining that the document that is being fed is skewed if the skew of the document is over the allowable skew.

4. The cut sheet feeding device as claimed in claim 3, wherein each allowable skew stored in the allowable skew storing means is calculated according to the distance between a corresponding one of the size sensors and the document passage detecting means and is stored in a table.

5. The cut sheet feeding device as claimed in claim 4, wherein:

the document feeding means is a step motor;

the skew of the document detected by the skew calculating means is represented by the number of pulses applied to the step motor after the size detecting means detects the document and until the document passage detecting means detects the document;

the allowable skew for each document size stored in the allowable skew storing means is a corresponding number of pulses; and the skew comparing means compares the number of detected pulses with the stored number.

* * * * *